US008030257B2

(12) United States Patent
Habeeb et al.

(10) Patent No.: US 8,030,257 B2
(45) **Date of Patent: *Oct. 4, 2011**

(54) CATALYTIC ANTIOXIDANTS

(75) Inventors: Jacob Joseph Habeeb, Westfield, NJ (US); Steven Paul Rucker, Warren, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 512 days.

This patent is subject to a terminal disclaimer.

(21) Appl. No.: 11/418,953

(22) Filed: May 5, 2006

(65) Prior Publication Data

US 2006/0258549 A1 Nov. 16, 2006

Related U.S. Application Data

(60) Provisional application No. 60/680,683, filed on May 13, 2005.

(51) Int. Cl.

| | |
|---|---|
| ***C10M 159/12*** | (2006.01) |
| ***C10M 169/04*** | (2006.01) |
| ***C10M 137/10*** | (2006.01) |
| ***C08K 3/08*** | (2006.01) |
| ***B62M 9/00*** | (2006.01) |

(52) U.S. Cl. ..... 508/459; 508/382; 508/208; 508/591; 508/379; 508/537

(58) Field of Classification Search ..... 508/459, 508/379, 537, 382, 383, 208, 591
See application file for complete search history.

(56) References Cited

U.S. PATENT DOCUMENTS

| | | | | |
|---|---|---|---|---|
| 2,398,414 | A | 4/1946 | Denison, Jr. et al. | 260/607 |
| 2,543,074 | A | 2/1951 | Stewart et al. | 252/45 |
| 2,577,719 | A | 12/1951 | Stewart | 252/48.6 |
| 3,291,817 | A | 12/1966 | Rockett | 260/429.9 |
| 3,351,647 | A | 11/1967 | Butler et al. | 260/429.9 |
| 3,399,139 | A | 8/1968 | Forbes et al. | 252/37 |
| 3,476,532 | A | 11/1969 | Hartman | 44/7 |
| 3,649,660 | A | 3/1972 | Brown, Jr. et al. | 260/429 CY |
| 3,707,498 | A | 12/1972 | Milsom | 252/33.6 |
| 3,745,129 | A | 7/1973 | Brown, Jr. et al. | 252/49.7 |
| 3,764,534 | A | 10/1973 | Blejean et al. | 252/42.7 |
| 4,066,561 | A | 1/1978 | Nnadi | 252/33.4 |
| 4,083,792 | A | 4/1978 | Nnadi | 252/18 |
| 4,122,033 | A | 10/1978 | Black | 252/400 A |
| 4,397,749 | A | 8/1983 | Shippey | 252/42.7 |
| 4,427,560 | A | 1/1984 | Holstedt et al. | 252/42.7 |
| 4,705,641 | A | 11/1987 | Goldblatt et al. | 252/35 |
| 4,766,228 | A | 8/1988 | Born et al. | 556/25 |
| 4,849,123 | A | 7/1989 | Tipton et al. | 252/75 |
| 4,859,353 | A | 8/1989 | Colclough | 252/46.3 |
| 4,867,890 | A | 9/1989 | Colclough et al. | 252/327 E |
| 4,882,446 | A | 11/1989 | Born et al. | 556/25 |
| 5,015,402 | A | 5/1991 | Yodice et al. | 252/32.7 E |
| 5,439,604 | A | 8/1995 | Waddoups et al. | 252/32.7 E |
| 5,631,212 | A | 5/1997 | Vrahopoulou | 508/192 |
| 5,650,381 | A | 7/1997 | Gatto et al. | 508/364 |
| 5,736,493 | A * | 4/1998 | Garmier | 508/491 |
| 5,786,307 | A * | 7/1998 | Igarashi et al. | 508/365 |
| 5,824,627 | A | 10/1998 | McConnachie et al. | 508/363 |
| 5,863,872 | A * | 1/1999 | Garmier | 508/491 |
| 5,877,128 | A | 3/1999 | Greer | 508/113 |
| 5,906,969 | A * | 5/1999 | Fyfe | 508/364 |
| 6,121,211 | A | 9/2000 | Stachew et al. | 508/304 |
| 6,165,949 | A | 12/2000 | Berlowitz et al. | 508/363 |
| 6,180,575 | B1 | 1/2001 | Nipe | 508/227 |
| 6,475,960 | B1 | 11/2002 | Berlowitz et al. | 508/110 |
| 6,610,636 | B2 | 8/2003 | Berlowitz et al. | 508/363 |
| 2002/0086803 | A1 | 7/2002 | Berlowitz et al. | 508/371 |
| 2006/0189492 | A1 * | 8/2006 | Bera et al. | 508/570 |
| 2006/0199743 | A1 * | 9/2006 | Rosenbaum et al. | 508/110 |

FOREIGN PATENT DOCUMENTS

| | | |
|---|---|---|
| EP | 0 275 351 B1 | 7/1988 |
| EP | 0 280 579 B1 | 8/1988 |
| EP | 0 944 595 B1 | 4/2004 |
| GB | 1 322 699 | 7/1973 |
| GB | 1 358 961 | 7/1974 |
| JP | SHO 54-119432 | 9/1979 |
| WO | WO 86/04601 | 8/1986 |
| WO | WO 86/04602 | 8/1986 |

* cited by examiner

*Primary Examiner* — Glenn Caldarola
*Assistant Examiner* — Vishal Vasisth
(74) *Attorney, Agent, or Firm* — Liza Montalvo

(57) ABSTRACT

The present invention is directed to lubricating oils of improved antioxidancy comprising a base oil selected from the group consisting of mineral oils, synthetic oils and mixtures thereof containing an effective amount of one or more organometallic compound and/or coordination complex selected from the group consisting of (a) a metal or metal cation with more than one oxidation state, above the ground state, and two or more anions, (b) a metal or metal cation with more than one oxidation state above the ground state and one or more bidentate or tridentate ligands, (c) a metal or metal cation with more than one oxidation state above the ground slate, and one or more amines and one or more ligands, and (d) mixtures thereof, to a method for improving the antioxidancy of formulated lubricating oil compositions by the addition thereto of an effective amount of the aforementioned organometallic compound, and/or coordination complex, and to an additive concentrate containing the aforementioned organometallic compound and/or coordination complex.

18 Claims, No Drawings

CATALYTIC ANTIOXIDANTS

This application claims the benefit of U.S. Ser. No. 60/680,683 filed May 13, 2005.

BACKGROUND OF THE INVENTION

1. Field of the Invention

The present invention relates to lubricating oil compositions comprising a base oil selected from the group consisting of mineral oils, synthetic oils and mixtures thereof boiling in the lubricating oil boiling range and additives which neutralize the prooxidants which cause the oxidative decomposition of the lubricating oil composition.

2. Description of the Related Art

Currently, lubricating oil formulations are rendered resistant to oxidative degradation by the addition to the lubricating oil formulations of free radical scavenger antioxidants such as sterically hindered phenols, hindered amines and mixture thereof and hydroperoxide decomposers such as zinc dialkyldithiophosphate.

Most of such antioxidants as are presently used are consumed by the oxidation promoters in the oil (the prooxidants) on a stoichiometric basis. Antioxidants can be added to lubricating oil formulations only in limited quantities and consequently even if and when the maximum practical amount is added they are quickly consumed and disappear, with the undefended oil rapidly oxidizing with their disappearance.

Other antioxidants such as copper acetylacetonates, while consuming the prooxidants on a more than stoichiometric basis are still themselves used-up at a rate of less than about 10:1 and therefore, while superior to the phenolic and aminic antioxidants are still not sufficiently long lived or suitable for the next generation of extended drain lube oils or sealed for life/filled for life lubricant environments.

Prooxidants are continuously generated in the lubricant during routine use or added/introduced into the oil by blowby gases, or exhaust gas recirculation as during the operation of internal combustion engines.

U.S. Pat. No. 4,705,641 teaches the combination of copper and molybdenum salts as being an effective antioxidant and antiwear additive for hydrocarbons such as lube oils. The total concentration of copper salt and molybdenum salt is such that the concentration of metal or metal ion may range from about 0.006 wt % to about 0.5 wt %, preferably from about 0.009 wt % to about 0.1 wt % of the basestock. The concentration of the copper salt may range between about 0.002 wt % and about 0.3 wt % while the concentration of the molybdenum salt ranges between about 0.004 wt % and about 0.3 wt %. The copper salt preferably is selected from the group of carboxylates consisting of oleates, stearates, naphthenates and mixtures thereof. The molybdenum salt preferably is selected from the group of carboxylates consisting of naphthenates, oleates, stearates and mixtures thereof.

U.S. Pat. No. 4,122,033 discloses an oxidation inhibitor and a method for using the oxidation inhibitor for hydrocarbon materials, particularly lube oils. This patent discloses that one or more transition metal containing compounds can be utilized in combination with one or more peroxide decomposer compounds selected from aliphatic amines, alkyl selenides, alkyl phosphines and phosphates wherein the aliphatic and alkyl portions of said compound each contain from about 1 to about 50 carbon atoms as oxidation inhibitors in organic compositions subject to auto-oxidation. Among the transition metal compounds useful according to the patent are the salts of scandium, titanium, vanadium, chromium, manganese, iron, cobalt, nickel, copper, yttrium, zirconium, niobium, molybdenum, tellurium, ruthenium, rhodium, palladium, and silver, to mention a few. This patent further states, at column 8, that when a combination of metals is used a synergistic effect will be noted if the sum of electromotive force voltages favors the presence of the stronger inhibitor and/or the weaker catalyst and is, generally, positive. Additionally, the combination will be effective as a corrosion inhibitor at concentrations of about 100 ppm by weight, or less, when the amount of peroxide decomposer complexing agents or the like approaches 20,000 ppm by weight. In effect the effectiveness of the transition metal compounds is dependent upon relatively high concentrations of the peroxide decomposer compounds.

U.S. Pat. No. 2,398,414 teaches organic selenium compounds and organic tellurium compounds of the formula:

$$R—(X)_m—R_1$$

wherein R and $R_1$ are like or unlike radicals of alkyl structure at least one of which contains not less than 8 carbon atoms, X is selenium or tellurium and m is 1 or 2. These organic compounds are useful as mineral oil additives and are also useful as antioxidants for vegetable oils, rubber and other organic materials which are subject to oxidative deterioration. The "alkyl" radicals can be straight or branched chain in nature as well as being saturated or unsaturated and can also be cycloalkyl or cycloaliphatic. They can be substituted by aromatic groups such as phenyl, hydroxyphenyl and aminophenyl groups. Polar groups such as chloro-, bromo-, hydroxyl-, ether, keto, amine, free carboxyl, metallo carboxyl, carboxy ester, mercapto, mercaptide, mono-, di- and polysulfide, etc., may also be substituted in the R and $R_1$ groups. See also U.S. Pat. No. 2,543,074 and U.S. Pat. No. 2,577,719.

U.S. Pat. No. 4,867,890 teaches oil soluble organo copper compounds as antioxidants. The copper may be in the μ cuprous or cupric form. The copper may be in the form of the copper dihydrocarbyl thio- or di-thio-phosphates wherein copper may be substitute for zinc in such compounds. The copper may also be in the form of the copper salt of a synthetic or natural carboxylic acid, e.g., $C_{10}$-$C_{18}$ fatty acids such as stearic or palmitic, but the unsaturated acids such as oleic or the branched carboxylic acids such as naphthenic acids of molecular weight from 200 to 500 or the synthetic acids are preferred. Oil-soluble copper dithiocarbamate as well as copper sulfonates, phenates, and acetylacetonates may also be used. The copper compound is employed in an amount sufficient to contribute 5 to 500 ppm copper to the oil.

U.S. Pat. No. 5,650,381 teaches a lubricating oil composition which contains from about 100 to 400 ppm of molybdenum from a molybdenum compound which is substantially free of active sulfur and about 750 to 5,000 ppm of a secondary diaryl amine. The combination of ingredients is reported as providing the lubricating oil with improved oxidation control and friction modifier performance. Oil soluble molybdenum compounds include those prepared from a molybdenum source such as ammonium molybdenates, alkali and alkaline earth metal molybdeates, molybdenum trioxide and molybdenum acetyl-acetonates and an active hydrogen compound such as alcohols and polyols, primary and secondary amines and polyamines, phenols, ketones, anilines, etc.

Molybdenum salts such as the carboxylates, e.g., molybdenum naphthenate, are a preferred group of molybdenum compounds.

U.S. Pat. No. 6,121,211 teaches a lubricating oil composition comprising a major amount of a base oil of lubricating viscosity and a minor amount of at least one thiocarbamate and a sludge preventing and seal protecting amount of at least one aldehyde or epoxide or mixture thereof. The thiocarbamates include those of the formula:

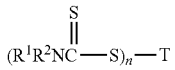

wherein $R^1$ and $R^2$ are independently alkyl of 1 to about 7 carbon atoms, aryl, aralkyl or together form an alicylic or heterocyclic ring in which the ring is completed through the nitrogen and wherein when n is 2, T is a divalent metal. Suitable relevant metals include alkaline earth metals, cadmium, magnesium, ten, molybdenum, iron, copper, nickel, cobalt, chromium and lead. Specific examples include cadmium dibutyldithiocarbamate, cadmium, dioctyl dithiocarbamate, cadmium octylbutyl-di-thiocarbamate, magnesium dibutyl dithiocarbamate, magnesium dioctyl dithio-carbamate, cadmium dicetyldithio carbamate. The patent contained no examples in which a divalent metal dialkyl dithiocarbamate was added to oil either alone or in combination with the aldehyde or epoxide.

JP 53024957 teaches the liquid phase oxidation of cyclohexane into cyclohexanol by oxidizing the cyclohexane with an oxygen containing gas in the liquid phase in the presence of metal salts selected from the group consisting of Cr, V and W of an organic acid or a chelate compound as a catalyst. In the process the cyclohexane is first converted into cyclohexyl hydroperoxide which is then rapidly decomposed into cyclohexanol and cyclohexanone. Examples of catalyst include chromium, vanadium and tungsten naphthenates and chromium acetylacetonate. The amount of the catalyst is preferably 0.1 to 20 ppm more preferably 0.5-10 ppm of the metal atom based on the cyclohexane.

U.S. Pat. No. 4,766,228 teaches a metal dihydrocarbyldithiophosphoryl dithio-phosphate material of the formula

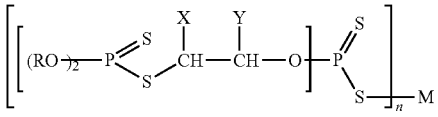

wherein R is a monovalent substantially hydrocarbon-containing radical of 1-30 carbons, x and y are each H or a monovalent substantially hydrocarbon containing radical of 1 to 30 carbons, M is a metal selected from zinc, cadmium, lead and antimony or an oxygen and/or sulfur-containing molybdenum complex and n is the valence of the metal. This material is useful as a lubricant additive (see also U.S. Pat. No. 4,882,446).

U.S. Pat. No. 5,439,604 teaches compositions containing metal salts, preferably copper or zinc salts, of polyalkenyl substituted monounsaturated mono- or dicarboxylic acids which may be used as a compatibilizing material for mixtures of dispersants, detergents, anti-wear and antioxidant materials. The antioxidant can be a copper antioxidant and include copper salts of $C_{10}$-$C_{13}$ fatty acid, copper salt of naphthenic acid, copper dithiocarbamate, copper sulfonate, copper phenate or copper acetylacetonate.

U.S. Pat. No. 5,631,212 teaches an engine oil of improved wear resistance and antioxidancy comprising base oil, an oil soluble copper salt, an oil soluble molybdenum salt, a Group II metal salicylate and a borated polyalkenyl succinimide. Molybdenum salts are the oil soluble salts of synthetic or natural organic acids, preferably $C_4$ to $C_{30}$ saturated and unsaturated fatty acids, e.g., molynaphthanate, molyhexanate, molyoleate, molyxanthate and molytallate.

U.S. Pat. No. 4,066,561 teaches organometallic complexes of the formula:

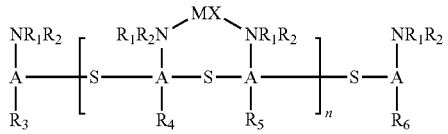

wherein, as defined in the patent n is an integer of from 1 to about 10, preferably from 1 to about 5;

A is an aromatic moiety, preferably phenyl or naphthyl;

M is a polyvalent metal, such as, for example, Be, Mg, Ca, Ba, Mn, Co, Ni, Pd, Cu, Zn and Cd;

X is a radical selected from the group consisting of organophosphoro, organocarboxyl, organoamino, organosulfonyl, organothio, organooxy, nitrate, nitrite, phosphate, sulfate, sulfonate, oxide, hydroxide, carbonate, sulfite, fluoride, chloride, bromide and iodide;

$R_1$ and $R_2$ are alkyl of from 1 to about 10 carbon atoms, aryl, hydrogen,

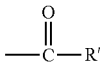

or a combination thereof;

R' is alkyl of from 1 to about 10 carbon atoms, aryl or hydrogen;

$R_3$, $R_4$, $R_5$ and $R_6$ are hydrogen, alkyl of from 1 to about 200 carbon atoms, aryl, alkyl-substituted aryl where the alkyl substituent is comprised of form 1 to about 200 carbon amounts, carboxyaryl, carbonylaryl, aminoaryl, mercaptoaryl, halogenoaryl or combinations thereof.

The metal complexes reportedly stabilize the lubricant to which they are added against oxidation.

U.S. Pat. No. 5,824,627 teaches a lube oil composition containing a major to amount of a lube base oil and a minor amount of an additive having the formula $M_{4-y}Mo_yS_4L_nQ_z$ and mixtures thereof, wherein M is a metal selected from Cr, Mn, Fe, Co, Ni, Cu, and W, L is independently selected organic groups selected from dithiophosphates, thioxanthates, phosphates, dithiocarbamates, thio-phosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}Mo_yS_4$ core. Thiocubane cores are preferred and these typically have the formula $M_{4-y}Mo_yS_4L_nQ_z$, wherein y is 1 to 3, n is 2 to 6 and z is 0 to 4.

U.S. Pat. No. 3,707,498 teaches antioxidant additives comprising a mixture of a metal dialkyldithiocarbamate and a tertiaryalkyl primary amine. The metal is from Group IIb, IVa and Va and preferably are zinc cadmium, lead and antimony.

U.S. Pat. No. 3,649,660 teaches silyl ocenes as being useful antioxidants for organopolysiloxane fluids. The silylorganometallocenes are selected from the class of (a) polymers of the formula

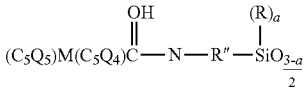

(b) copolymers having units of the formula

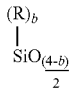

and at least one unit of (a), and (c) disiloxanes of the formula

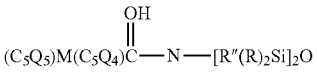

where R is a monovalent hydrocarbon radical, R" is a divalent hydrocarbon radical, and (C5Q4)M(C5Q5) is an organometallocene, where Q is selected from hydrogen, an electron donating organic radical, and an electron withdrawing organic radical and M is a transition metal, a is a whole number equal from 0 to 2 and b is a whole number equal from 0 to 3.

In U.S. Pat. No. 3,649,600 Transition metal is defined to include all metals of Group III to VIII of the Periodic Table capable of forming a π complex with a cyclopentadienyl radical to form a metallocene. The transition metals that are operative in the present invention are, for example, metals having atomic numbers 22 to 28, 40 to 46, and 71 to 78, such as titanium, vanadium, chromium, manganese, iron, cobalt, nickel, zirconium, columbium, molybdenum, technetium, ruthenium, rhodium, palladium, hafnium, tantalum, tungsten, rhenium, osmium, iridium and platinum (see also U.S. Pat. No. 3,745,129).

U.S. Pat. No. 3,351,647 teaches a composition of the general formula:

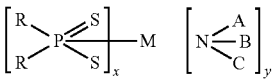

wherein R is a substantially hydrocarbon radical; M is a metal selected from the group consisting of zinc, calcium, copper, nickel, cobalt, chromium, lead, and cadmium; A, B and C are radicals selected from the class consisting of hydrogen and substantially hydrocarbon radicals; x is the valence of M; y is from about 0.5 to about 6.

The compositions are useful as oil additives and function is antioxidant and antiwear agents.

U.S. Pat. No. 4,427,560 teaches a formulation containing among other additives an oxidation inhibitor.

The oxidation inhibitors or antioxidants have high enough molecular weights to ensure that they remain stable in a hot crankcase oil, e.g., 300° F. and, in addition, enhance the corrosion preventive properties of the copper and lead corrosion inhibitors also present in the formulation by interrupting or terminating the attack of oxidants upon copper/lead-bearing metal. One type of corrosion is an oxidative process involving the loss of electrons from the corroding metal by an oxidant such as oxygen, air, nitrogen oxides, partially burned gasoline, blow-by products and the like. The oxidation inhibitors comprising sulfur bridge, bis hindered phenols effectively limit or prevent the attack of oxidants on copper/lead metal.

The bis(dithiobenzyl) metal derivatives preferably have the formula:

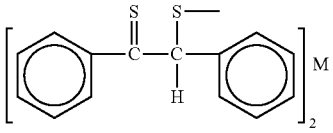

U.S. Pat. No. 5,015,402 teaches basic metal and multimetal dihydrocarbyl-phosphorodithioates and phosphoromonothioates as antioxidant additives. These materials are represented by the general formula:

$$[Z]_d[RO)_2PSS]_yM_aX_b \quad (I)$$

wherein M and X represent different metal cations selected from the group consisting of zinc, copper, chromium, iron, copper, manganese, calcium, barium, lead, antimony, tin and aluminum; Z is an anion selected from oxygen, hydroxide and carbonate; R is independently a linear or branched alkyl group of 1 to about 200 carbon atoms, or a substituted or unsubstituted aryl group of 6 to about 50 carbon atoms; a and b are integers of at least one and are dependent upon the respective oxidation states of M and X; y is a whole integer which is dependent upon the oxidation states of M and X; and d is an integer of 1 or 2.

U.S. Pat. No. 3,764,534 teaches a composition comprising a lubricating oil and at least one thioorganometallic complex of the formula:

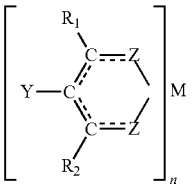

in which M is selected from the transition metals and zinc, cadmium, tin, lead, antimony and bismuth; n is the oxidation degree of M, $R_1$ and $R_2$ are each a monovalent hydrocarbon radical having one to 20 carbon atoms and 0 to 3 heteroatoms selected from the group consisting of halogen, oxygen, sulfur and nitrogen; Y is selected from the hydrogen atom and the radicals R', R'O, R'S and R'CO in which R' is a hydrocarbon radical of 1 to 20 carbon atoms; Y and $R_1$ or $R_2$ may form a divalent hydrocarbon radical containing 1 to 20 carbon atoms and 0-3 heteroatoms selected form oxygen, sulfur and nitrogen; and each atom Z is oxygen or sulfur, at least one of the 2n atoms Z being sulfur.

It is recited that these materials exhibit high antioxidancy activity even at high temperature. They can be used with base oils of petroleum origin as well as with synthetic base oils. See also GB 1,322,699.

GB 1,358,961 teaches that 9,10-dihydroanthracene acts synergistically with certain metal β-diketone complexes to provide antioxidancy. The metal β-diketone complexes are of the formula $$M(\text{-}O\text{—}CR_1\text{=}CR_2\text{—}CR_3\text{=}O)_n$$

wherein M is a metal, n is 2 or 3, $R_2$ is hydrogen or an alkyl group having 1 to 20 carbon atoms and $R_1$ and $R_3$ are alkyl, aryl or alkoxy groups having 1-10 carbons.

U.S. Pat. No. 4,849,123 teaches drivetrain fluids comprising oil soluble transition metal compounds which address low temperature thickening of ATF's and high temperature thickening or gear oils. The oil soluble transition metal compound is a branched chain oil-soluble transition metal salt with the proviso that the transition metal is not zinc, wherein said transition metal salt is a salt wherein the non-metal moiety is selected from dihydrocarbylthio- or dithiophosphate, a dihydrocarbylthio- or dithiocarbamate, or mixtures thereof and wherein the metal is selected from copper, cobalt, tungsten, titanium, manganese, iron, chromium, nickel, vanadium, molybdenum or mixtures thereof.

As a consequence of more stringent and demanding performance requirements on lubricating oils, for example fill for life oils, sealed bearings oils and greases, or modern extended drain engine lubricating oils to perform better, for longer periods and under more severe conditions of temperature and load over longer times as manifested by current and future lubricating oil specifications, particularly engine oil classifications for diesel lubricants (PC7 and PC8) and passenger car lubricants (GF-3 and GF-4), more efficient, longer lasting and more robust antioxidants are required for use in the lubricants.

DESCRIPTION OF THE INVENTION

The present invention in one aspect is directed to lubricating oil formulations of enhanced antioxidancy including but not limited to greases, gear oils, hydraulic oils, brake fluids, manual and automatic transmission fluids, other energy transferring fluids, tractor fluids, diesel compression ignition engine oils, gasoline spark ignition engine oils, turbine oils and the like comprising a base oil selected from the group consisting of natural oils, petroleum-derived mineral oils, synthetic oils and mixtures thereof boiling in the lubricating oil boiling range and an effective amount of a catalytic antioxidant comprising, consisting of or consisting essentially of one or more oil soluble organometallic compounds and/or organo metallic coordination complexes selected from the group consisting of:

(a) one or more metal(s) or metal cation(s) having more than one oxidation state above the ground state, excluding iron and nickel, complexed, bonded, or associated with two or more anions;

(b) one or more metal(s) or metal cation(s) having more than one oxidation state above the ground state, excluding iron and nickel, complexed, bonded, or associated with one or more bidentate or tridentate ligands;

(c) one or more metal(s) or metal cations having more than one oxidation state above the ground state, excluding iron and nickel, complexed, bonded or associated with one or more anions and one or more ligands;

(d) mixtures thereof provided the anion and/or ligand does not itself render the metal cation inactive, i.e., renders the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetate. The reactivity of any given metal complex will depend on the ionic strength of the ligands and the coordination geometry around the metal center. These factors will affect the ease with which the metal center can effect the oxidation state change necessary for catalytic decomposition of the hydroperoxide or peroxide species.

In another aspect the invention is directed to a method for improving the oxidation resistance of a lubricating oil comprising a lubricating base oil selected from the group consisting of natural oils, petroleum-derived mineral oils, synthetic oils and mixtures thereof boiling in the lubricating oil boiling range and optionally one or more additives, said method comprising adding to the lubricating oil an effective amount of one or more oil soluble organometallic compounds and/or coordination complexes selected from the group consisting of:

(a) one or more metal(s) or metal cations having more than one oxidation state above the ground state, excluding iron and nickel, complexed, bonded or associated with two or more anions;

(b) one or more metal(s) or metal cations having more than one oxidation state above the ground state, excluding iron and nickel, complexed, bonded or associated with one or more bidentate or tridenate ligands;

(c) one or more metal(s) or metal cations having more than one oxidation state above the ground state, excluding iron and nickel, complexed, bonded or associated with one or more anions and one or more ligands; and (d) mixtures thereof provided the anion and/or ligand does not itself render the metal cation inactive, i.e., rendering the metal cation unable to change from one oxidation state above the ground state to another oxidation state above the ground state, decompose or cause polymerization of the metal salt thereby rendering the metal cation inactive as a peroxide decomposer, and further provided that (a) when the metal or metal cation is molybdenum, the ligand is not thiocarbamate, thiophosphate, dithiocarbamate or dithiophosphate and (b) when the metal or metal cation is copper the ligand is not acetyl acetonate.

In another aspect the invention is directed to an additive concentrate comprising one or more oil soluble organometallic compounds and/or coordination complexes selected from the group consisting of:

(a) one or more metal(s) or metal cations having more than one oxidation state above the ground state, excluding iron and nickel, complexed, bonded or associated with two or more anions;

(b) one or more metal(s) or metal cations having more than one oxidation state above the ground state, excluding iron and nickel, complexed, bonded or associated with one or more bidentate or tridentate ligands;

(c) one or more metal(s) or metal cations having more than one oxidation state above the ground state, excluding iron and nickel, complexed, bonded or associated with one or more anions and one or more ligands; and (d) mixtures thereof provided the anion and/or ligand does not itself render the metal cation inactive, i.e., rendering the metal cation unable to change from one oxidation state above the ground state to another oxidation state above the ground state, decompose or cause polymerization of the metal salt thereby rendering the metal cation inactive as a peroxide decomposer and further provided that when the metal or metal cation is molybdenum, the ligand is not thiocarbamate, thiophosphate, dithiocarbamate or dithiophosphate in combination with at least one additional material selected from detergents, dispersants, viscosity index improvers, antiwear additives, friction modifiers, an additional antioxidant, pour-point depressants, corrosion inhibitors, anti-foaming agents, antirust additives, carrier oils seal compatibility additives and the like. Preferably the oil soluble organometallic compound and/or coordination complexes are utilized in the absence of or in the presence of a reduced amount of any added antioxidant, most preferably in the absence of any added antioxidant(s). The oil soluble organometallic compounds and/or coordination complexes do not undergo anion and/or ligand displacement reactions (exchange reaction) which alter the composition and/or stability of the compound or complex rendering the ineffective as a catalytic additive. That is, the original anions and/or ligands which do not fit within the coordination sphere of the metal is/are not replaced partially or totally by other anions and/or ligands which fit within the coordination sphere of the metal because such partial or total replacement would interfere with the ability of the electrons in the metal orbital to change from one oxidation state above the ground state to another oxidation state above the ground state rendering the common and/or complex ineffective as a catalytic antioxidant additive. Compounds or complexes which during hydroperoxide decomposition themselves undergo decomposition, e.g., splitting off sulfur, are also excluded insofar as such compounds or complexes as a result of such decomposition cease to function as catalytic antioxidants but rather functions as, e.g., antiwear additives due to the bonding interaction of the sulfur with the iron of the engine or piece subject to wear.

Base Oil

A wide range of lubricating base oils is known in the art. Lubricating base oils that are useful in the present invention are both natural oils, synthetic oils, and unconventional oils, natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| Base Oil Properties | | | |
|---|---|---|---|
| | Saturates | Sulfur | Viscosity Index |
| Group I | <90 &/or | >0.03% & | ≧80 & <120 |
| Group II | ≧90 & | ≦0.03% & | ≧80 & <120 |
| Group III | ≧90 & | ≦0.03% & | ≧120 |
| Group IV | Includes polyalphaolefins (PAO) and Gas-to-Liquids (GTL) products | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked basestocks, including synthetic oils such as polyalphaolefins, alkyl aromatics and synthetic esters are also well known basestock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of accept-ably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cyclo-alkyl groups, cycloalkenyl groups and other related hydrocarbyl groups. The hydrocarbyl groups can range from about $C_6$ up to about $C_o$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics may be produced by well-known processes. See Friedel-Crafts and Related Reactions, Olah, G. A. (ed), Interscience Publishers, New York, 1963, ACS Petroleum Chemistry Preprent 1053-1058, "Poly n alkylbenzene Compounds: A Class of Thermally Stable and Wide Liquid Range Fluids", Eapen et al, Phila., 1984. See also U.S. Pat. No. 5,055,626, EP 168 534A, U.S. Pat. No. 4,658,072. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed), Interscience Publishers, New York, 1964. Many homogeneous or heterogeneous solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Other alkylation technology uses zeolites such as ultra stable zeolite Y or solid super acids.

Alkylbenzenes are used as lubricant basestocks, especially for low-temperature applications (arctic vehicle service and refrigeration oils) and in papermaking oils. They are commercially available from producers of linear alkylbenzenes (LABs) such as Vista Chemical Co, Huntsman Chemical Co., Chevron Chemical Co., and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipenta-erythritol with one or more monocarboxylic acids containing from about 5 to about 10 carbon atoms. These esters are widely available commercially, for example, the Mobil P-41 and P-51 esters of ExxonMobil Chemical Company).

Desirable esters include pentaerythritol esters, derived from mono-, di-, and poly pentaerythritol polyols reacted with mixed hydrocarbyl acids ($RCO_2H$), and where a substantial amount of the available —OH groups are converted to esters. The substituent hydrocarbyl groups, R, of the acid moiety and ester comprise from about $C_6$ to about $C_{16}$ or more, with preferable ranges being about $C_6$ to about $C_{14}$, and may comprise alkyl, alkenyl, cycloalkyl, cycloalkenyl, linear, branched, and related hydrocarbyl groups, and can optionally contain S, N, and/or O groups. Pentaerythritol esters with mixtures of substituent hydrocarbyl groups, R, are often preferred. For example, substituent hydrocarbyl groups, R, may comprise a substantial amount of $C_8$ and $C_{10}$ hydrocarbyl moieties in the proportions of about 1:4 to 4:1. In a mode, a preferred penta-erythritol ester has R groups comprising approximately about 55% $C_8$, about 40% $C_{10}$, and the remainder approximately 5% $C_6$ and $C_{12+}$ moieties. For example, one useful pentaerythritol ester has a viscosity index of about 148, a pour point of about 3° C. and a kinematic viscosity of about 5.9 cSt at 100° C. The pentaerythritol esters can be used in lubricant compositions at concentrations of about 3% to about 30%, preferably about 4% to about 20%, and more preferably about 5% to about 15%.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

As used herein, the following terms have the indicated meanings:

(a) "wax"—hydrocarbonaceous material having a high pour point, typically existing as a solid at room temperature, i.e., at a temperature in the range from about 15° C. to 25° C., and consisting predominantly of paraffinic materials;

(b) "paraffinic" material: any saturated hydrocarbons, such as alkanes. Paraffinic materials may include linear alkanes, branched alkanes (isoparaffins), cycloalkanes (cycloparaffins; mono-ring and/or multi-ring), and branched cycloalkanes;

(c) "hydroprocessing": a refining process in which a feedstock is heated with hydrogen at high temperature and under pressure, commonly in the presence of a catalyst, to remove and/or convert less desirable components and to produce an improved product;

(d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

(e) "hydrodewaxing" (or catalytic dewaxing): a catalytic process in which normal paraffins (wax) and/or waxy hydrocarbons are converted by cracking/fragmentation into lower molecular weight species, and by rearrangement/isomerization into more branched iso-paraffins;

(f) "hydroisomerization" (or isomerization or isodewaxing): a catalytic process in which normal paraffins (wax) and/or slightly branched iso-paraffins are converted by rearrangement/isomerization into more branched iso-paraffins;

(g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

The term "hydroisomerization/hydrodewaxing" is used to refer to one or more catalytic processes which have the combined effect of converting normal paraffins and/or waxy hydrocarbons by cracking/fragmentation into lower molecular weight species and, by rearrangement/isomerization, into more branched iso-paraffins. Such combined processes are sometimes described as "catalytic dewaxing" or "selective hydrocracking".

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydro-isomerized or isodewaxed Fischer-Tropsch (F-T) material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. Reference herein to Kinematic viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic (>90% saturates), and may contain mixtures of monocycloparaffins and multicyclo-paraffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

Isomerate/isodewaxate base stock(s), derived from waxy feeds, which are also suitable for use in this invention, are paraffinic fluids of lubricating viscosity derived from hydroisomerized or isodewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

Slack wax is the wax recovered from petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es), being secured from petroleum oils, may contain sulfur and nitrogen containing compounds. Such heteroatom compounds must be removed by hydrotreating (and not hydrocracking), as for example by hydrode-sulfurization (HDS) and hydrodenitrogenation (HDN) so as to avoid subsequent poisoning/deactivation of the hydroisomerization catalyst.

The term GTL base oil/base stock and/or wax isomerate base oil/base is stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a dumbbell blend wherein the blend exhibits a viscosity within the aforesaid recited range.

In a preferred embodiment, the GTL material, from which the GTL base stock(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for an F-T synthesis reaction is 2.0, but there are many reasons for using other than a stoichiometric to ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_5$," is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) is/are derived is wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization/hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from removal of oxygenates while others may benefit from oxygenates treatment. The hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking/hydroisomerized/isodewaxing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; to 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using either well known solvent or catalytic dewaxing processes and either the entire hydro-isomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydro-isomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as is SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s), isomerized or isodewaxed wax-derived base stock(s), have a beneficial kinematic viscosity advantage over conventional Group II and Group III base stocks and base oils, and so may be very advantageously used with the instant invention. Such GTL base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

In the present invention the one or more isomerate/isodewaxate base stock(s), the GTL base stock(s), or mixtures thereof, preferably GTL base stock(s) can constitute all or part of the base oil.

One or more of the wax isomerate/isodewaxate base stocks and base oils can be used as such or in combination with the GTL base stocks and base oils.

One or more of these waxy feed derived base stocks and base oils, derived from GTL materials and/or other waxy feed materials can similarly be used as such or further in combination with other base stocks and base oils of mineral oil origin, natural oils and/or with synthetic base oils.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

The GTL base stock/base oil and/or wax hydroisomerate/isodewaxate, preferably GTL base oils/base stocks obtained from F-T wax, more preferably GTL base oils/base stocks obtained by the hydroisomerization/isodewaxing of F-T wax, can constitute from about 5 to 100 wt %, preferably between about 20 to 40 to up to 100 wt %, more preferably about 70 to 100 wt % of the total of the base oil, the amount employed being left to the practitioner in response to the requirements of the finished lubricant.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C., on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV @ 100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);

b. divide the total carbon-13 integral area (chart divisions or area counts) by the average carbon number from step a. to obtain the integral area per carbon in the sample;

c. measure the area between 29.9 ppm and 29.6 ppm in the sample; and d. divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, to then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base oils and base oils derived from synthesized hydrocarbons, for example, hydroisomerized or isodewaxed waxy synthesized hydrocarbon, e.g., Fischer-Tropsch waxy hydrocarbon base oils are of low or zero sulfur and phosphorus content. There is a movement among original equipment manufacturers and oil formulators to produce formulated oils of ever increasingly reduced sulfur, sulfated ash and phosphorus content to meet ever increasingly restrictive environmental regulations. Such oils, known as low SAP oils, would rely on the use of base oils which themselves, inherently, are of low or zero initial sulfur and phosphorus content. Such oils when used as base oils can be formulated with the catalytic antioxidant additive disclosed herein replacing or used part of the heretofore additive such as ZDDP previously employed in stoichiometric or super stoichiometric amounts. Even if the remaining additive or additives included in the formulation contain sulfur and/or phosphorus the resulting formulated oils will be lower or low SAP.

Low SAP formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 15,000, for example) or mono- and polycarboxylic esters thereof (the acidic acid esters, mixed $C_{3-8}$ fatty acid esters, or the $C_{13}$Oxo acid diester of tetraethylene glycol, for example).

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-methylphenyl) siloxanes.

Another class of synthetic lubricating oil is esters of phosphorus-containing acids. These include, for example, tricresyl phosphate, trioctyl phosphate, diethyl ester of decane-phosphonic acid. Another class of oils includes polymeric tetrahydrofurans and the like. For examples of other synthetic lubricating base stocks see the seminal work "Synthetic Lubricants", Gunderson and Hart, Reinhold Publ. Corp., NY, 1962.

Organometallic Catalytic Hydroperoxide Decomposes/Antioxidant

Organometallic compounds and/or coordination complexes comprising a metal having more than one oxidation state above the ground state and anions and/or ligands which do not either render the metal cation inactive, that is, the metal cation is rendered unable to change from one oxidation state above the ground state to another oxidation stated above the ground state, or cause polymerization of the metal salt or are susceptible to decomposition thereby rendering the metal inactive have been found to be catalytic antioxidant hydroperoxide decomposer in the absence of other peroxide decomposer compounds.

The metal component having more than one oxidation state above the ground state of the organometallic compound and/or organometallic coordination complex catalytic hydroperoxide decomposer is selected from the group consisting of transition metal elements 21 through 30, excluding iron and nickel, elements 39 through 48, elements 72 through 80, metals of the lanthanide metals of the actinide series and mixtures thereof. Preferable the metal component is selected from the group consisting of transition metal elements 21 through 30, excluding iron and nickel, elements 39 through 48, elements 72 though 80 and mixtures thereof. More preferably the metal component is selected from the group consisting of transition metal elements 21 through 30, excluding iron, nickel and copper, elements 39 though 48, elements 72 through 80 and mixtures thereof. Still more preferably the metal component is selected from the group consisting of transition metal elements 21 though 30 excluding iron, nickel and copper, elements 39 through 48 excluding molybdenum, elements 72 through 80 and mixtures thereof.

The most preferred metals are chromium and manganese.

What is essential is the ability of the metal to exhibit more than one oxidation state above its ground state and that the anions and/or ligand with which it complexes to form the organometallic compound and/or coordination complex do not interfere with the ability of the metal orbital to change from one oxidation state above the ground state to another oxidation state above the ground state, and the complex should be in its least polymeric form—preferably monomeric.

In the practice of the present invention the organometallic compound and/or coordination complex is employed in a catalytic amount, it having been found that the organometallic compound and/or coordination complex is not consumed on a stoichiometric basis by the hydroperoxide, but rather itself reacts with at least 10 equivalent of hydroperoxide per equivalent of metal, preferably at least about 15 equivalents of hydroperoxide per equivalent of metal, more preferably at least about 12 equivalents of hydroperoxide per equivalent of metal, still more preferably at least 15 equivalents of hydroperoxide per equivalent of metal most preferably about 50 equivalents or more of hydro-peroxide per equivalent of metal. Thus, the catalytic antioxidant organometallic compound and/or coordination complex can be utilized in very low concentration, typically an amount in the range of about 10 to 1000 ppm based on the metal, preferably about 25-1000 ppm based on the metal, more preferably about 25-800 ppm based on the metal.

In the organometallic compounds and/or coordination complexes useful in the present invention the organic anionic and/or ligand moiety complexing the metal can be either neutral (e.g., bipyridyl) or anionic (e.g., acac). To avoid either self-polymerization or polymerization with/through other species in the oil, the ligands, generally, should avoid high levels of polar functionality, high-polarity atoms in the functional groups, reactive structures such as olefins, and unstable geometries whose strain energy could be relieved through polymerization.

Such organic moiety include materials derived from carboxylic acids which may be aromatic acids, naphthenic acids, aliphatic acids, cyclic, branched aliphatic acids and mixtures thereof. Among the useful ligands are acetylacetonate, naphthenates, phenates, stearates, carboxylates, etc. Nitrogen-, oxygen-, sulfur-, and phosphorus-containing ligands, preferably oxygen-, nitrogen-, or oxygen and nitrogen-containing ligands (e.g., bipyridines, thiophenes, thiones, carbamates, phosphates, thiocarbamates, thiophosphates, dithiocarbamates, dithiophosphates, etc.), also give rise to useful organometallic compounds and/or coordinating complexes provided the metal orbital remain free to exhibit its ability to change from one oxidation state above the ground state to another oxidation state above the ground state. It is necessary that the organometallic compound, coordination complex, or mixtures thereof, not be polymerized, but remain as individual molecules. Polymerization as is typically encountered with materials such as the molybdenum dithiocarbamates reported in the literature as antiwear agents prevents the material from functioning as a catalytic antioxidant/hydroperoxide decomposer because through polymerization the metal orbitals are satisfied in their quest for electrons and become stabilized, thus loosing the ability to shift from one oxidation state above the ground state to another oxidation state above the ground state, which has been found necessary for an organo metallic compound and/or organo metallic coordination complex to function as a catalyst hydroenoxide decomposer. In the case where the metal or metal cation is molybdenum, the ligand is not thiocarbamate, thiophosphate, dithiocarbamate or dithiophosphate or where the metal or metal cation is copper the ligand is not acetyl acetonate.

Other components, including effective amounts of co-base stocks, and various performance additives can be advantageously used with the components of this invention. Co-base stocks include polyalphaolefin oligomeric low- and moderate- and high-viscosity oils, dibasic acid esters, polyol esters, other hydrocarbon oils such as those derived from gas to liquids type technology, supplementary hydrocarbyl aromatics and the like.

The instant invention can be used with additional lubricant components in effective amounts in lubricant compositions, such as for example polar and/or non-polar lubricant base oils, and performance additives such as for example, but not limited to, supplementary oxidation inhibitors which are not themselves peroxide decomposers, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, and others. For a review of many commonly used additives see Klamann in Lubricants and Related Products, Verlag Chemie, Deerfield Beach, Fla.; ISBN 0-89573-177-0, which also gives a good discussion of a number of the lubricant additives mentioned below. Reference is also made "Lubricant Additives" by M. W. Ranney, published by Noyes Data Corporation of Parkridge, N.J. (1978).

The types and quantities of performance additives used in combination with the instant invention in lubricant compositions are not limited by the examples shown herein as illustrations.

Antiwear and EP Additives

Internal combustion engine lubricating oils require the presence of antiwear and/or extreme pressure (EP) additives in order to provide adequate antiwear protection for the engine. Increasingly specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithio-phosphate in which the primary metal constituent is zinc, or zinc dialkyldithio-phosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithio-carbamate trimer complex ($R{=}C_8$-$C_{18}$ alkyl) are also useful antiwear agents. The use or addition of such materials should be kept to a minimum if the object is to produce low SAP formulations. Each of the aforementioned patents is incorporated by reference herein in its entirety.

Esters of glycerol may be used as antiwear agents. For example, mono-, di, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. Each of the aforementioned patents is incorporated herein by reference in its entirety.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothia-diazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Poly-isobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Supplementary Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example, each of which is incorporated by reference herein in its entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4, 4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydro-carbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

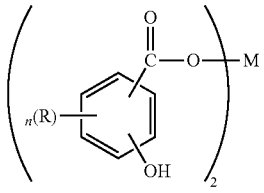

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium to salicylates and other related components (including borated detergents).

Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose. Each of the aforementioned patents is incorporated herein in its entirety by reference.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the poly-amine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044, which are incorporated herein in their entirety by reference.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpoly-amines and polyalkenylpolyamines such as polyethylene polyamines. One example is propoxylated hexamethylenediamine. Representative examples are shown in U.S. Pat. No. 4,426,305, incorporated herein by reference.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight poly-propylene, polybutylene, and other polyalkylene compounds to give alkyl substituents on the benzene ring of phenol having an average 600-100,000 molecular weight.

Examples of 1-1$N(R)_2$ group-containing reactants are alkylene polyamines, principally polyethylene polyamines. Other representative organic compounds containing at least one $HN(R)_2$ group suitable for use in the prepara-tion of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, penta-ethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2.721,878; and 3,250,715 describe useful pour point depressants and/or the preparation thereof. Each of these references is incorporated herein in its entirety. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932, which are incorporated herein by reference in their entirety. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. No. 5,824,627; U.S. Pat. No. 6,232,276; U.S. Pat. No. 6,153,564; U.S. Pat. No. 6,143,701; U.S. Pat. No. 6,110,878; U.S. Pat. No. 5,837,657; U.S. Pat. No. 6,010,987; U.S. Pat. No. 5,906,968; U.S. Pat. No. 6,734,150; U.S. Pat. No. 6,730,638; U.S. Pat. No. 6,689,725; U.S. Pat. No. 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in the table below, as well as other amounts mentioned in this patent, are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Supplementary Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

EXAMPLES

In the following examples except where otherwise indicated the test solutions were examined by carbon-13 nuclear magnetic resonance (NMR) spectroscopy on a JEOL GSX-400 NMR spectrometer. All the NMR work described in this and the following examples was performed on the same instrument, at a carbon Larmor frequency of 100 Megahertz. The sample temperature was varied in situ over a range from 27° C. to 55° C. Between 200 and 400 transients were acquired for each spectrum, with a 90 degree pulse on the carbon nucleus, and inverse-gated proton decoupling. The relaxation delay was varied between 3 seconds, for samples where the metal acetylacetonate contained a paramagnetic metal center, and 20 seconds where the metal acetylacetonate did not contain a paramagnetic center.

A spectrum was acquired at 27° C., to measure the initial relative concentrations of t-butyl hydroperoxide and t-butyl alcohol. Subsequently, the temperature was raised to 35° C., and maintained at this temperature for 250 minutes. Spectra were acquired periodically, and the decomposition of the t-butyl hydroperoxide was monitored by comparing the oxygen-bonded carbon resonances for the hydroperoxide and the alcohol.

Oxygen was not added to the system, although it was not explicitly excluded through degassing of the sample. The starting (hydro)peroxide concentration is stable and was measured at low temperature, before reaction; it decreased monotonically at elevated temperature, indicating that there is no intermediate increase in (hydro)peroxide caused by the metal under study. Also, the total number of moles of liquid (hydro) peroxide added to the sample far exceeds the moles of oxygen in the NMR sample tube.

Example 1

A test solution was prepared as follows:

64 mg (0.18 mmole) of $Cr(acac)_3$ was dissolved in 4.8 g (39 mmoles) of deuterated chloroform, with 200 mg (0.83 mmoles) of t-butyl hydroperoxide (3M in iso-octane).

This mixture represents a hydroperoxide: chromium acetylacetonate molar ratio of 4.5 to 1.

During 95 minutes of heating at 27° C. only about 5% of the hydroperoxide was decomposed to alcohol, as tabulated in Table 2.

TABLE 2

| Time (minutes) | % t-butanol |
|---|---|
| 12 | 1.9 |
| 38 | 5.4 |
| 79 | 4.4 |
| 95 | 4.9 |

Subsequently, during 250 minutes of heating the sample tube of Example 1 at 35° C., 84 percent of the initial hydroperoxide was decomposed by the chromium acetylacetonate. These results are tabulated in Table 3.

TABLE 3

| Time (minutes) | % t-butanol |
|---|---|
| 0 | 4.9 |
| 12 | 19.9 |
| 45 | 42.5 |
| 75 | 57.5 |
| 103 | 62.5 |
| 153 | 73.6 |
| 185 | 74.4 |
| 245 | 84.5 |

An additional 500 mg of TBHP was added to the sample, to test the ability of the $Cr(acac)_3$ to decompose this additional amount. The aggregate ratio of TBHP to $Cr(acac)_3$ then became 15.9. A spectrum at 0 minutes was acquired at 27° C. to provide a baseline spectrum of the new mixture. Five additional spectra were acquired at 35° C., as in the earlier series. The continued decomposition occurred as recorded in Table 4:

TABLE 4

| Time (minutes) | % t-butanol |
|---|---|
| 0 | 33.9 |
| 12 | 34.9 |
| 72 | 38.8 |

TABLE 4-continued

| Time (minutes) | % t-butanol |
|---|---|
| 132 | 50.5 |
| 222 | 62.7 |
| 282 | 68.5 |

The final ratio of hydroperoxide decomposed by chromium acetylacetonate (on a molar basis) was 10.9:1 at 35° C., based on % t-butanol produced.

A similar sequence of heating and data acquisition was performed on a solution containing t-butyl hydroperoxide and deuterated chloroform, without the chromium acetylacetonate. This control run (documented in Table 5) showed no hydroperoxide decomposition throughout the same temperature profile.

TABLE 5

| Time (minutes) | % t-butanol |
|---|---|
| 0 | 5.0 |
| 30 | 3.6 |
| 92 | 3.2 |
| 167 | 4.1 |

Example 2

Repetition of the experiment of Example 1 but with the further addition of up to a final hydroperoxide:chromium acetylacetonate molar ratio of 84:1, shows that the chromium acetylacetonate continues to decompose hydro-peroxide to alcohol. Continued activity at the 84:1 ratio indicates that the chromium compound is acting catalytically, rather than stoichiometrically.

The $Cr(acac)_3$-catalyzed thermal decomposition of t-butyl hydro-peroxide was monitored by acquiring spectra at increasing ratios of hydro-peroxide to chromium. These results are tabulated in Table 6. After each addition of hydroperoxide, a spectrum was acquired at 27° C. to determine the solution composition. Subsequent to each addition of hydroperoxide, one or more spectra were acquired at elevated temperature to accelerate decomposition. Up through spectrum 26, the high temperature runs were performed at 35° C. Run 27 and later, the high temperature runs were executed at 40° C., to expedite the reaction.

The percent of hydroperoxide decomposed to the alcohol was calculated by comparing the alcohol C—OH integral with the hydroperoxide C—OOH integral. These results are tabulated in Table 6.

TABLE 6

| TBHP: $Cr^{+3}$ Ratio | Spectrum Number | % of TBHP Decomposed |
|---|---|---|
| 4.5 | 4 | 4.9 |
| | 5 | 19.9 |
| | 6 | 42.5 |
| | 7 | 57.5 |
| | 8 | 62.5 |
| | 9 | 73.6 |
| | 10 | 74.4 |
| | 11 | 84.5 |
| | 12 | 94.8 |
| 15.9 | 13 | 33.9 |
| | 14 | 34.9 |
| | 15 | 38.8 |
| | 16 | 50.5 |
| | 18 | 62.7 |

TABLE 6-continued

| TBHP: $Cr^{+3}$ Ratio | Spectrum Number | % of TBHP Decomposed |
|---|---|---|
| 27.2 | 23 | 56.0 |
| | 24 | 56.0 |
| | 25 | 56.6 |
| | 26 | 58.5 |
| | 27 | 61.8 |
| | 29 | 77.8 |
| | 30 | 83.2 |
| 38.6 | 31 | 62.4 |
| | 32 | 65.9 |
| | 33 | 71.0 |
| | 34 | 75.8 |
| | 35 | 88.7 |
| | 36 | 90.0 |
| 49.9 | 37 | 74.5 |
| | 41 | 79.7 |
| | 42 | 89.1 |
| 61.3 | 43 | 75.2 |
| | 46 | 88.0 |
| 84.0 | 47 | 69.1 |
| | 48 | 73.2 |

It is seen based on the percent hydroperoxide decomposed at the 84:1 molar ratio, that the chromium acetylacetonate is functioning catalytically and not stoichiometrically, a hydroperoxide:chromium molar ratio of about 61.5:1.

Example 3

The same heating profile and data acquisition sequence was tested on an aralkyl hydroperoxide (cumene hydroperoxide) to show the generality of the reaction.

53 mg (0.15 mmole) of $Cr(acac)_3$ was dissolved in 4.0 g (39 mmoles) of deuterated chloroform, with 400 mg (2.6 mmoles) of cumene hydroperoxide (80% technical grade).

This solution gave a hydroperoxide:chromium acetylacetonate molar ratio of 17.2 to 1. The decomposition was monitored by comparing the integrals of the oxygen-bonded carbons of the cumene hydroperoxide and the cumyl alcohol.

The $Cr(acac)_3$-catalyzed thermal decomposition of cumene hydro-peroxide to cumyl alcohol was monitored by acquiring spectra at increasing ratios of hydroperoxide to chromium (as summarized in Table 7). After each addition of hydroperoxide, a spectrum was acquired at 27° C. to determine the solution composition, and then a series of spectra were acquired at 35° C. to monitor the decomposition. Spectra from number 15 and onward were acquired at 40° C., to expedite the reaction. The reaction proceeds at a rate that increases with temperature.

The percent of hydroperoxide decomposed to the alcohol was calculated by comparing the hydroperoxide C—OOH integral with the alkyl group-bearing aromatic carbons of both the hydroperoxide and alcohol. These results are tabulated below in Table 7:

TABLE 7

| CHP: $Cr^{+3}$ Ratio | Spectrum Number | % of CHP Decomposed |
|---|---|---|
| 17.7 | 1 | 18.5 |
| | 2 | 22.0 |
| | 3 | 49.0 |
| | 4 | 55.4 |
| 34.4 | 7 | 42.4 |
| | 8 | 46.4 |
| | 9 | 45.8 |
| | 10 | 47.1 |
| | 11 | 48.6 |

TABLE 7-continued

| CHP: $Cr^{+3}$ Ratio | Spectrum Number | % of CHP Decomposed |
|---|---|---|
| | 12 | 49.4 |
| | 13 | 50.4 |
| | 14 | 54.7 |
| | 15 | 56.3 |
| | 16 | 56.4 |
| | 19 | 60.3 |

Decomposition of the hydroperoxide was measured, and observed to continue, for ratios up to 34.4 peroxide molecules per chromium atom again showing that the chromium compound is acting catalytically rather than stoichiometrically, a hydroperoxide:chromium acetylacetonate molar rate of about 20.7:1 based on % hydroperoxide decomposed.

Example A (Comparative)

A test solution was prepared as follows:

45 mg (0.17 mmole) of $Cu(acac)_2$ was dissolved in 4.8 g (39 mmoles) of deuterated chloroform, with 371 mg (2.6 mmoles) of t-butyl hydroperoxide (5.5M in decane).

This solution having an initial hydroperoxide:copper acetylacetonate molar ratio of about 15:1, was monitored by the same protocol described above in Example 1. It was found (as shown in Table 8) that at 35° C., copper acetylacetonate does not have a measurable effect on the decomposition of t-butyl hydroperoxide.

TABLE 8

| Temperature (° C.) | Time (minutes) | % Decomposed |
|---|---|---|
| 27 | 0 | 6.1 |
| 35 | 10 | 6.1 |
| 35 | 70 | 5.9 |
| 35 | 130 | 9.2 |
| 35 | 190 | 9.1 |
| 35 | 250 | 11.2 |

An identical mixture was heated sequentially to 35° C., 45° C., and 55° C., with spectra acquired at each temperature. It was found (as shown in Table 9) that at elevated temperature (45, 55° C.), the copper acetylacetonate showed hydroperoxide decomposition activity, a hydroperoxide: copper acetylacetonate molar rate of about 1.9:1 at 45° C. and about 9.15:1 at 55° C.

TABLE 9

| Temperature (° C.) | % Decomposed |
|---|---|
| 27 | 6.5 |
| 35 | 4.8 |
| 35 | 7.2 |
| 45 | 12.2 |
| 55 | 59.8 |

Example B (Comparative)

A test solution was prepared as follows:

60 mg (0.17 mmole) of $Fe(acac)_3$3 was dissolved in 4.8 g (39 mmoles) of deuterated chloroform, with 366 mg (2.6 mmoles) of t-butyl hydroperoxide (5.5M in decane).

This solution was monitored by the same protocol of increasing temperature (35° C., 45° C. and 55° C.) described above in the second part of Example A (Comparative). It was found that even when heated to 55° C., the ferric acetylacetonate showed insignificant hydroperoxide decomposition activity.

TABLE 10

| Temperature (° C.) | % Decomposed |
|---|---|
| 27 | 6.6 |
| 35 | 7.6 |
| 35 | 8.0 |
| 27 | 13.0 |
| 45 | 13.8 |
| 55 | 10.4 |

Example 4

A test solution was prepared as follows:

60 mg (0.17 mmole) of $Cr(acac)_3$ was dissolved in 4.8 g (39 mmoles) of deuterated chloroform, with 370 mg (2.6 mmoles) of t-butyl hydroperoxide (5.5M in decane), and 14 mg (0.018 mmole Zn) secondary zinc dialkyldithiophosphate (ZDDP in base oil).

This solution had an initial hydroperoxide:Cr(AcAc)3+ZDDP molar ratio of about 13.8:1 was monitored by the same protocol described above in the first part of Example A (Comparative). Because zinc dialkyldithiophosphate is an established antioxidant, it was sought to determine its effect on the hydro-peroxide decomposition efficiency of chromium acetylacetonate. It was found that after 250 minutes of heating at 35° C., about the same amount of hydro-peroxide had been decomposed as in the ZDDP-free chromium solution (as previously reported in Example 1, Table 4)

TABLE 11

| Temperature (° C.) | Time (minutes) | % Decomposed |
|---|---|---|
| 27 | 0 | 8.9 |
| 35 | 10 | 8.6 |
| 35 | 70 | 10.7 |
| 35 | 130 | 25.6 |
| 35 | 190 | 63.8 |
| 35 | 250 | 78.3 |

The solution containing both $Cr(acac)_3$ and ZDDP was prepared with the Zn concentration set to 10% of the Cr molar concentration, rather than 100%. Example 5, below, shows that secondary ZDDP on its own has performance that would not be considered catalytic (approx 6-7 TBHPs decomposed per Zn atom). Essentially the same performance was observed with primary ZDDP.

Example C (Comparative)

A test solution (representing a TBHP:Zn molar ratio of 47:1) was prepared as follows:

140 mg (0.18 mmole Zn) secondary zinc dialkyldithiophosphate (ZDDP in base oil) was mixed in 2.13 g (22.7 mmoles) of toluene, and 1.23 g (8.5 mmoles) of t-butyl hydroperoxide (5.5M in decane).

This solution was monitored by a protocol different from that in the first part of Example 4, being run at a lower temperature, and with the sample heating performed external to the NMR probe. Because zinc dialkyldithiophosphate is an established antioxidant, this experiment was run to determine the hydro-peroxide decomposition efficiency of ZDDP relative to chromium acetyl-acetonate. It was found that after 220 minutes of heating (at temperatures from 40° C. to 75° C.), a moderate amount of TBHP was decomposed (approximately 6-7 moles TBHP per mole of Zn). The results are shown in Table 12.

TABLE 12

| Temperature (° C.) | Time (minutes) | % TBHP Remaining | % TBA Purchased |
|---|---|---|---|
| 27 | 15 | 91 | 9 |
| 27 | 1440 | 89 | 11 |
| 40 | 40 | 89 | 11 |
| 60 | 60 | 88 | 12 |
| 75 | 60 | 86 | 14 |
| 75 | 60 | 86 | 14 |

Example 5

A test solution was prepared as follows:

45 mg (0.18 mmole) of $Mn(acac)_2$ was dissolved in 2.2 g (23.6 mmoles) of toluene, with 1.28 g (8.9 mmoles) of t-butyl hydroperoxide (5.5M in decane).

This solution gave a hydroperoxide:manganese (II) acetylacetonate molar ratio of 50 to 1. This solution was monitored by a protocol analogous to that in Example C. It was found that after 165 minutes of heating, the bulk of the hydroperoxide had been decomposed to tertiary butyl alcohol. The results are presented in Table 13 show an about 40:1 peroxide decomposed:$Mn(AcAc)_2$ ratio.

TABLE 13

| Temperature (° C.) | Time (minutes) | % Decomposed |
|---|---|---|
| 27 | 15 | 27 |
| 100 | 45 | 75 |
| 100 | 75 | 86 |
| 100 | 105 | 81 |
| 100 | 135 | 85 |
| 100 | 165 | 82 |

Example 6

A test solution was prepared as follows:

60 mg (0.17 mmole) of $Mn(acac)_3$ was dissolved in 2.2 g (24.1 mmoles) of toluene, with 1.22 g (8.5 mmoles) of t-butyl hydroperoxide (5.5M in decane), and this solution gave a hydroperoxide:manganese (III) acetylacetonate molar ratio of 50 to 1. Upon addition of the manganese (III) acetylacetonate, the solution boiled vigorously. The solution composition was monitored by a protocol analogous to that in Example C. It was found that the bulk of the hydroperoxide had been decomposed to tertiary butyl alcohol at ambient temperature. The results presented in Table 14 show an about 43:1 peroxide decomposed:Mn $(AcAc)_3$ ratio.

TABLE 14

| Temperature (° C.) | Time (minutes) | % TBHP | % TBP | % TBA |
|---|---|---|---|---|
| 27 | 15 | 18 | 5 | 77 |
| 100 | 45 | 10 | 8 | 82 |
| 100 | 75 | 4 | 6 | 90 |
| 100 | 105 | 4 | 7 | 89 |
| 100 | 135 | 5 | 10 | 86 |
| 100 | 165 | 6 | 7 | 87 |

Example 7

A test solution was prepared as follows:

70 mg (0.17 mmole) of Cr(picolinate)$_3$ was dissolved in 2.2 g (24.8 mmoles) of toluene, with 1.20 g (8.4 mmoles) of t-butyl hydroperoxide (5.5M in decane), and this solution had an initial hydroperoxide:chromium (III) picolinate molar ratio of 50 to 1. The solution composition was monitored by a protocol analogous to that in Example C. It was found that the bulk of the hydroperoxide had been decomposed to tertiary butyl alcohol. The results presented in Table 15 show an about 26:1 peroxide decomposed:Cr(picolinate)$_3$ ratio.

TABLE 15

| Temperature (° C.) | Time (minutes) | % TBHP | % TBP | % TBA |
|---|---|---|---|---|
| 27 | 15 | 93 | 0 | 7 |
| 100 | 45 | 84 | 0 | 16 |
| 100 | 75 | 60 | 6 | 33 |
| 100 | 105 | 50 | 10 | 39 |
| 100 | 135 | 38 | 14 | 48 |
| 100 | 165 | 34 | 14 | 52 |

Example D (Comparative)

A test solution was prepared as follows:

45 mg (0.13 mmole) of Zn(acac)$_2$.4H$_2$O was dissolved in 4.6 g (39.0 mmoles) of deuterated chloroform, with 368 mg (2.6 mmoles) of t-butyl hydroperoxide (5.5M in decane), and this solution gave a hydroperoxide:Zn (II) acac molar ratio of 20 to 1. The solution composition was monitored with an initial NMR spectrum at 27° C., followed immediately by another acquisition at 35° C., and a third acquisition after 210 minutes at 35° C. It was found that the Zn did not catalyze hydroperoxide decomposition. The results are shown in Table 16.

TABLE 16

| Temperature (° C.) | Time (minutes) | % Decomposed |
|---|---|---|
| 27 | 15 | 11 |
| 35 | 45 | 9 |
| 35 | 210 | 10 |

Example 8

A test solution was prepared as follows:

120 mg (0.19 mmole) of Cu(stearate)$_2$ was dissolved in copper 2.0 g (22.3 mmoles) of toluene, with 1.37 g (9.5 mmoles) of t-butyl hydroperoxide (5.5M in decane), and this solution gave a hydroperoxide:copper (II) stearate molar ratio of 50 to 1. The solution composition was monitored by a protocol analogous to that in Example C. It was found that the bulk of the hydroperoxide had been decomposed to tertiary butyl alcohol. The results presented in Table 17 show an about 36:1 peroxide decomposed:copper (stearate)$_2$ ratio.

TABLE 17

| Temperature (° C.) | Time (minutes) | % TBHP | % TBP | % TBA |
|---|---|---|---|---|
| 27 | 15 | 88 | 2 | 9 |
| 100 | 45 | 33 | 4 | 63 |
| 100 | 75 | 28 | 10 | 63 |
| 100 | 105 | 22 | 6 | 72 |
| 100 | 135 | 20 | 8 | 73 |
| 100 | 165 | 17 | 11 | 72 |

Example E (Comparative)

A test solution was prepared as follows:

89 mg (0.21 mmole) of Sn(n-butyl)$_2$(acac)$_2$ was dissolved in 2.0 g (22.0 mmoles) of toluene, with 1.48 g (10.3 mmoles) of t-butyl hydroperoxide (5.5M in decane), and this solution gave a hydroperoxide:tin (IV) di-n-butyl bis(2,4-pentanedione) molar ratio of 50 to 1. The solution composition was monitored by a protocol analogous to that in Example C. It was found that a modest amount of the hydroperoxide had been decomposed to tertiary butyl alcohol. The results presented in Table 18 show an about 7.5:1 peroxide decomposed:Sn(n-butyl)$_2$ (AcAc)$_2$ ratio.

TABLE 18

| Temperature (° C.) | Time (minutes) | % Decomposed |
|---|---|---|
| 27 | 15 | 8 |
| 100 | 45 | 12 |
| 100 | 75 | 15 |
| 100 | 105 | 14 |
| 100 | 135 | 16 |
| 100 | 165 | 15 |

Example F (Comparative)

A test solution was prepared as follows:

60 mg (0.19 mmole) of S (acac)$_2$ was dissolved in 2.1 g (23.1 mmoles) of toluene, with 1.36 g (9.5 mmoles) of t-butyl hydroperoxide (5.5M in decane), and this solution gave a hydroperoxide:tin (II) acetylacetonate molar ratio of 50 to 1. The solution composition was monitored by a protocol analogous to that in Example C, although the initial 27° C. spectrum was not acquired due to instrument malfunction. It was found that a modest amount of the hydroperoxide had been decomposed to tertiary butyl alcohol. The results presented in Table 19 show an about 5.5:1 peroxide decomposed to Sn(AcAc)$_2$ ratio.

TABLE 19

| Temperature (° C.) | Time (minutes) | % Decomposed |
|---|---|---|
| 100 | 45 | 12 |
| 100 | 75 | 13 |
| 100 | 105 | 14 |
| 100 | 135 | 11 |
| 100 | 165 | 11 |

Example 9

A test solution was prepared as follows:

61 mg (0.19 mmole) of $MoO_2(acac)_2$ was dissolved in 2.2 g (24.0 mmoles) of toluene, with 1.32 g (9.2 mmoles) of t-butyl hydroperoxide (5.5M in decane), and this solution gave a hydroperoxide:molybdenum (VI) acetylacetonate molar ratio of 50 to 1. The solution composition was monitored by a protocol analogous to that in Example C. It was found that a substantial fraction of the hydroperoxide had been decomposed to tertiary butyl alcohol. The results presented in Table 20 show on about 12:1 peroxide decomposed:$MoO_2(AcAc)_3$ ratio.

TABLE 20

| Temperature (° C.) | Time (minutes) | % TBHP | % TBP | % TBA |
|---|---|---|---|---|
| 27 | 15 | 80 | 0 | 20 |
| 100 | 45 | 69 | 2 | 29 |
| 100 | 75 | 67 | 6 | 28 |
| 100 | 105 | 64 | 11 | 25 |
| 100 | 135 | 59 | 13 | 28 |
| 100 | 165 | 62 | 14 | 25 |

Example 10

A test solution was prepared as follows:

100 mg (0.28 mmole) of $Cr(acac)_3$ was dissolved in 100 g of base oil, with 70 mg (7.77 mmoles) of t-butyl hydroperoxide (70% in water).

This solution gave a hydroperoxide:chromium acetylacetonate molar ratio of 27.8 to 1.

This solution was heated to 100° C., and monitored by titration for 180 minutes. In the presence of chromium acetylacetonate, the hydroperoxide was decomposed completely within 5 minutes. A control experiment was performed in the absence of chromium acetylacetonate, and showed only slight hydro-peroxide decomposition. The titration procedure involves incremental addition of hydroperoxide solution from a buret to a solution containing the peroxide decomposer under test. The extent of reaction is monitored calorimetrically with an iodine/iodide couple.

Example 11

A test solution was prepared as follows:

100 mg (0.28 mmole) of $Cr(acac)_3$ was dissolved in 100 g of base oil, with 294 mg (32.66 mmoles) of t-butyl hydroperoxide (70% in water).

This solution gave a hydroperoxide:chromium acetylacetonate molar ratio of 116.6 to 1.

This solution, 4.2-fold stronger in hydroperoxide concentration than the solution of Example 10, was heated to 100° C., and monitored by titration for 180 minutes as described in Example 10. In the presence of chromium acetyl-acetonate, the hydroperoxide was decomposed completely within 40 minutes. A control experiment was performed in the absence of chromium acetylacetonate, and showed negligible hydroperoxide decomposition.

Example G (Comparative)

A solution of 10.9 mmoles of tert-butyl hydroperoxide and 0.22 mmoles of molybdenum bis(dibutylcarbamoiddithioate—S,S') di-μ-thiodithioxodisterioisomer in 2.5 g toluene was evaluated fro hydroperoxide decomposition actively at 50° C. and 100° C. for 180 minutes at 50° C. for 180 minutes only 14% t-BHP was decomposed for a peroxide decomposed: molybdenum ratio of 7:1. At 100° C. for 180 minutes only 14% t-BHP was decomposed for a peroxide decomposed: molybdenum ratio of 5:1, both instances exhibiting an absence of catalytic activity.

What is claimed is:

1. A lubricating oil exhibiting improved resistance to oxidation by hydroperoxide comprising a base oil selected from the group consisting of natural oils, petroleum derived mineral oils, polyalphaolefins, hydrocarbyl aromatics, alkylene oxide polymers and interpolymers, silicon-based oils, esters of phosphorous-containing acids, polymeric tetrahydrofuron, non-conventional oils and mixtures thereof and an effective amount of a catalytic hydroperoxide decomposing antioxidant comprising one or more oil soluble organo metallic compound and/or organo metallic coordination complexes selected from the group consisting of chromium (acetyl acetonate)$_3$, chromium (picolinate)$_3$, manganese (acetyl acetonate)$_3$, $MoO_2$ (acetyl acetonate)$_3$, manganese (acetyl acetonate)$_2$ and mixtures thereof, said catalytic hydroxide decomposing antioxidant being present in an amount in the range of about 10 to 1000 ppm based on the metal and wherein said catalytic antioxidant improves the resistance to oxidation by hydroperoxide introduced into the lubricating oil via combustion gas blow-by or exhaust gas recirculation in internal combustion engines.

2. The lubricating oil of claim 1 wherein the catalytic antioxidant organometallic compound and/or organometallic coordination complex is present in an amount in the range of about 25 to 800 ppm based on the metal.

3. The lubricating oil of claim 1 wherein the catalytic antioxidant organometallic compound and/or organometallic coordination complex is used in the absence of any added supplementary antioxidant.

4. The lubricating oil of claim 2 wherein the catalytic antioxidant organometallic compound and/or organometallic coordination complex is used in the absence of any added supplementary antioxidant.

5. A method for improving the resistance of a lubricating oil to oxidation by hydroperoxide comprising adding to the lubricating oil a catalytic hydroperoxide decomposing antioxidant comprising one or more oil soluble organo metallic compound and/or organo metallic coordination complexes selected from the group consisting of metal acetyl acetonate, metal picolinate, metal stearate and mixtures thereof wherein the metal is selected from the group consisting of transition metals elements 21 through 30, excluding iron and nickel, elements 39 through 48, elements 72 though 80, metals of the lanthanide series, metals of the actinide series and mixtures thereof; and provided that when the metal is copper the oil soluble organometallic compound and/or organometallic coordination complex is not copper acetyl acetonate, wherein the catalytic hydroperoxide decomposing antioxidant is present in an amount in the range of about 10 to 1000 ppm based on the metal and wherein said catalytic antioxidant improves the resistance to oxidation caused by hydroperoxide introduced into the lubricating oil via combustion gas blow-by or exhaust gas recirculation in internal combustion engines.

6. The method of claim 5 wherein the metal is selected from the group consisting of transition metal elements 21 though 30, excluding iron and nickel, elements 39 though 48, elements 72 through 80 and mixtures thereof.

7. The method of claim 5 wherein the metal is selected from the group consisting of transition metal elements 21 though 30 excluding iron, nickel and copper, elements 39 through 48, elements 72 thorough 80 and mixtures thereof.

8. The method of claim 5 wherein the metal is selected from the group consisting of chromium, manganese and copper.

9. The method of claim 5 wherein the catalytic antioxidant organometallic compound and/or organometallic coordination complex is present in an amount in the range of about 25 to 800 ppm based on the metal.

10. The method of claim 5 wherein the catalytic antioxidant organometallic compound and/or organometallic coordination complex is used in the absence of any added supplementary antioxidant.

11. The method of claim 9 wherein the catalytic antioxidant organometallic compound and/or organometallic coordination complex is used in the absence of any added supplementary antioxidant.

12. The lubricating oil of claim 1 wherein the base oil is a GTL base oil, an isomerized wax base oil or mixture thereof.

13. The lubricating oil of claim 12 wherein the base oil is a GTL base oil derived from hydroisomerized Fischer-Tropsch wax.

14. The method of claim 5, 6, 7 or 8 wherein the lubricating oil comprises a base oil selected from the group consisting of mineral oil, polyalphaolefins, hydrocarbyl aromatics, alkylene oxide polymers and interpolymers, silicon-based oils, esters of phosphorus-containing acids, polymeric tetrahydrofurons, non-conventional oil and mixtures thereof.

15. The method of claim 14 wherein the base oil is a non-conventional base oil selected from GTL base oil, isomerized wax base oil and mixtures thereof.

16. The method of claim 15 wherein the base oil is a GTL base oil derived by the isomerization of Fischer-Tropsch wax.

17. The method of claim 5 wherein the metal is selected from the group consisting of chromium, manganese and mixtures thereof.

18. The method of claim 5 wherein the metal is selected from the group consisting of chromium, manganese, molybdenum and mixtures thereof.

* * * * *